US007458581B1

(12) United States Patent
Balosky

(10) Patent No.: US 7,458,581 B1
(45) Date of Patent: Dec. 2, 2008

(54) STAIRWAY TO HEAVEN

(76) Inventor: Donnalee Balosky, 247 W. Main St., Seville, OH (US) 44212

( * ) Notice: Subject to any disclaimer, the term of this patent is extended or adjusted under 35 U.S.C. 154(b) by 44 days.

(21) Appl. No.: 11/654,716

(22) Filed: Jan. 18, 2007

(51) Int. Cl.
*A63F 3/00* (2006.01)

(52) U.S. Cl. ..... 273/243; 273/254

(58) Field of Classification Search ..... 273/243, 273/248, 254
See application file for complete search history.

(56) References Cited

U.S. PATENT DOCUMENTS

D252,344 S 7/1979 Parker et al.
4,201,388 A * 5/1980 Cantelon ..... 273/251
5,071,133 A 12/1991 Smith
5,152,535 A 10/1992 Roberts
5,529,308 A 6/1996 Masakayan
5,988,641 A 11/1999 Lawrence
2003/0227132 A1 12/2003 Martin
2005/0133996 A1 6/2005 Jenkins

* cited by examiner

*Primary Examiner*—Vishu K. Mendiratta

(57) ABSTRACT

The invention is a Christian board game that teaches biblical principles. The Christian board game comprises a board game, dice, angel playing pieces, jewel crown, chance cards, guide cards, and jewel cards. By rolling the dice, the angel playing pieces follow the path designated on the board game and taking up a chance card, guide card, or jewel card when instructed. When a player lands on a jewel card spot, and answers the question correctly, a jewel is given to said player. The object of the game is to be the first player to ascend the stairway to heaven and have collected seven jewels to fill up his or her jewel crown.

3 Claims, 4 Drawing Sheets

10

STAIRWAY TO HEAVEN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to a board game that teaches Christian principles and morals.

B. Prior Art

The Martin Patent Application Publication (U.S. Pub. No. 2003/0227132) discloses a Christian board game that involves scripture verses cards, quiz cards, dice, and a board game.

The Lawrence patent (U.S. Pat. No. 5,988,641) discloses a bible game that includes a game board, a plurality of blessing cards, penalty cards, vision cards, angel cards, archangel cards, and dice.

The Smith patent (U.S. Pat. No. 5,071,133) discloses a board game that uses random movement of playing pieces by players to teach biblical principles.

The Jenkins Patent Application Publication (U.S. Pub. No. 2005/0133996) discloses a board game and method for teaching biblical values.

The Parker et al. patent (U.S. Pat. No. Des. 252,344) illustrates an ornamental design of a biblical board game.

The Cantelon patent (U.S. Pat. No. 4,201,388) discloses a game based upon the religious novel Pilgrim's Progress in which spiritual and moral values are an integrated part thereof.

The Roberts patent (U.S. Pat. No. 5,152,535) discloses a bible quiz game that includes a game board and a deck of cards containing biblical questions.

The Masakayan patent (U.S. Pat. No. 5,529,308) discloses an instructional board game which teaches spiritual principles as disclosed in the Bible to players.

BRIEF SUMMARY OF THE INVENTION

The invention is a Christian board game that teaches biblical principles. The Christian board game comprises a board game, dice, angel playing pieces, jewel crown, chance cards, guide cards, and jewel cards. By rolling the dice, the angel playing pieces follow the path designated on the board game and taking up a chance card, guide card, or jewel card when instructed. When a player lands on a jewel card spot, and answers the question correctly, a jewel is given to said player. The object of the game is to be the first player to ascend the stairway to heaven and have collected seven jewels to fill up his or her jewel crown.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
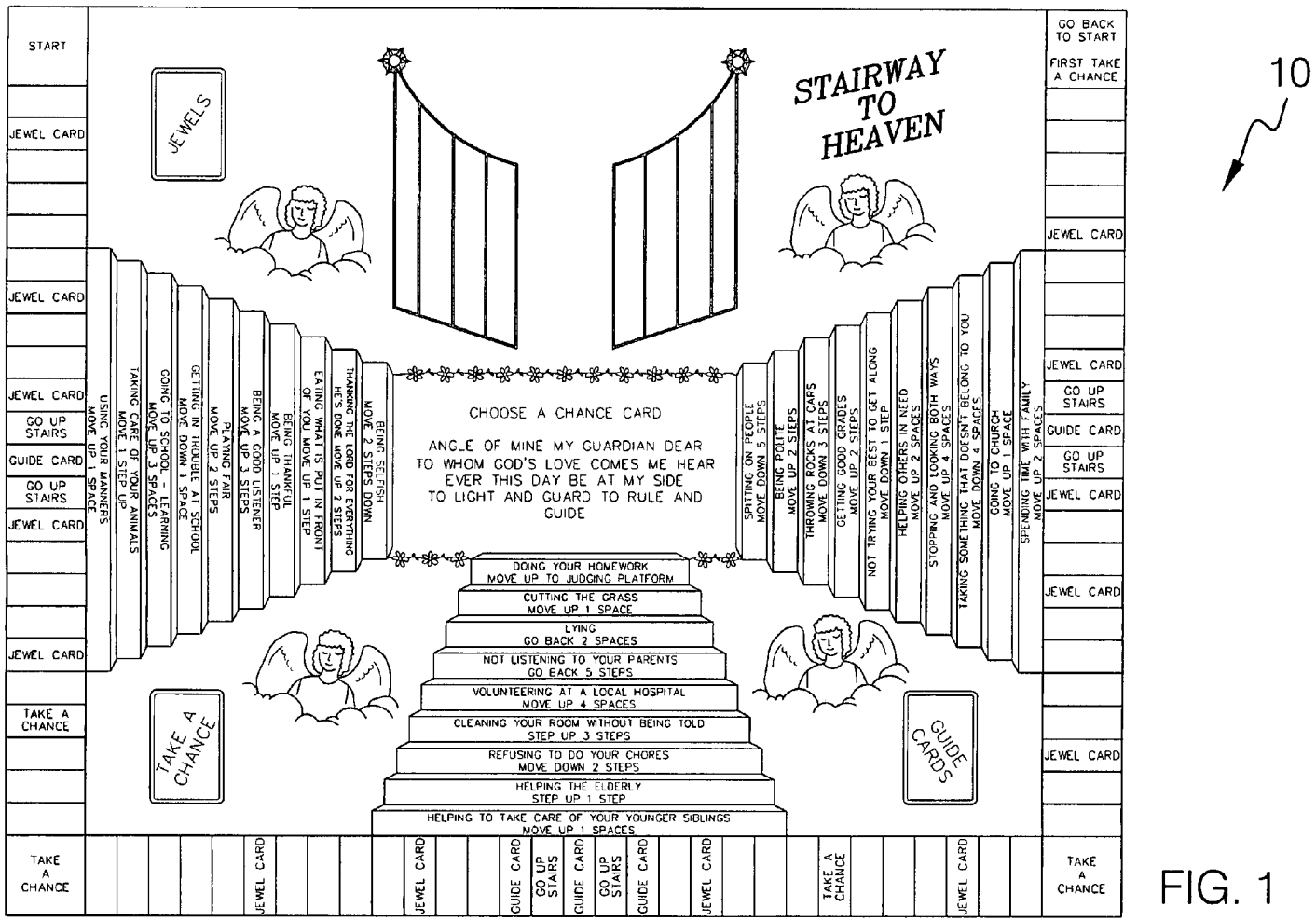
FIG. 1 illustrates the layout of the board game.
Figure 2:
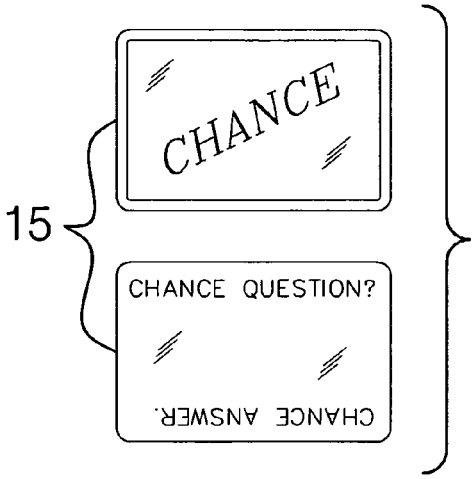
FIG. 2 illustrates the top and bottom side of a chance card.
Figure 3:
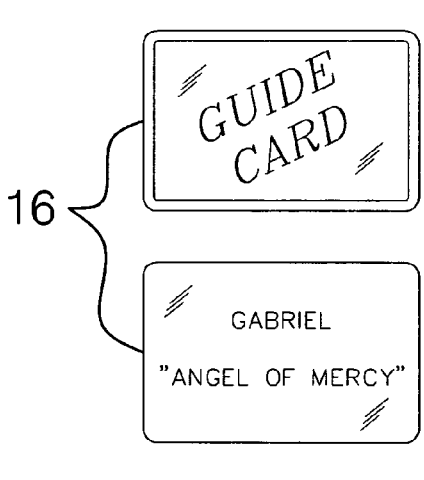
FIG. 3 illustrates the top and bottom side of a guide card.
Figure 4:
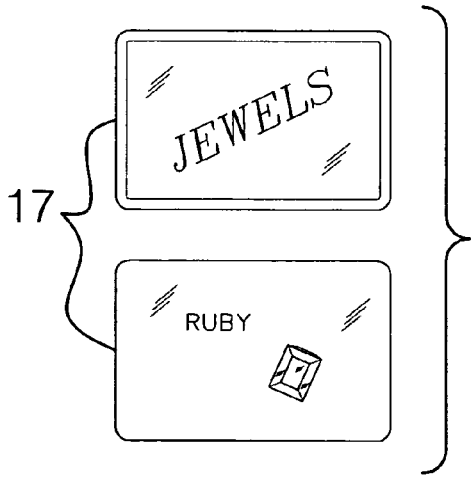
FIG. 4 illustrates the top and bottom side of a jewels card.
Figure 5:
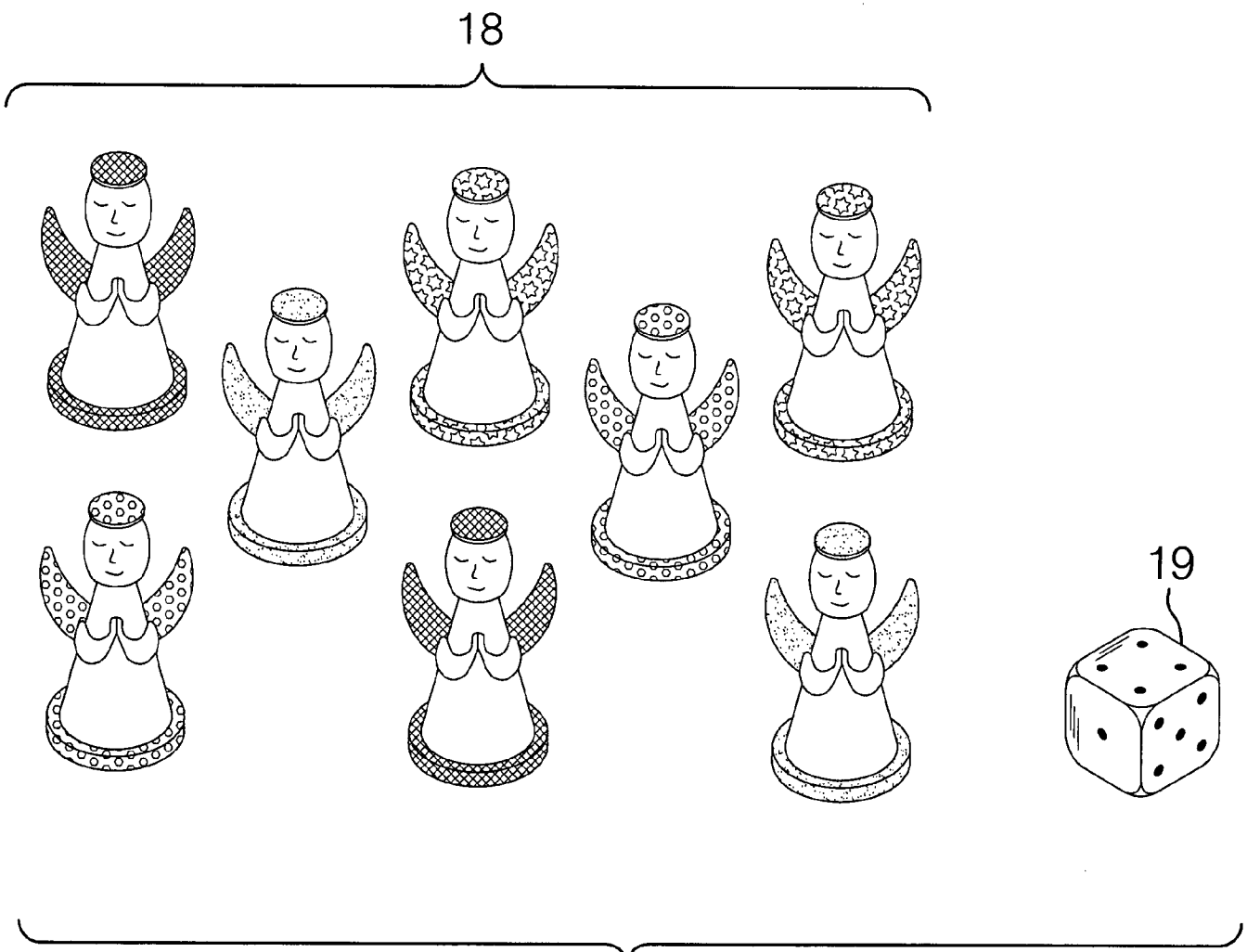
FIG. 5 illustrates the angel player pieces and dice.
Figure 6:
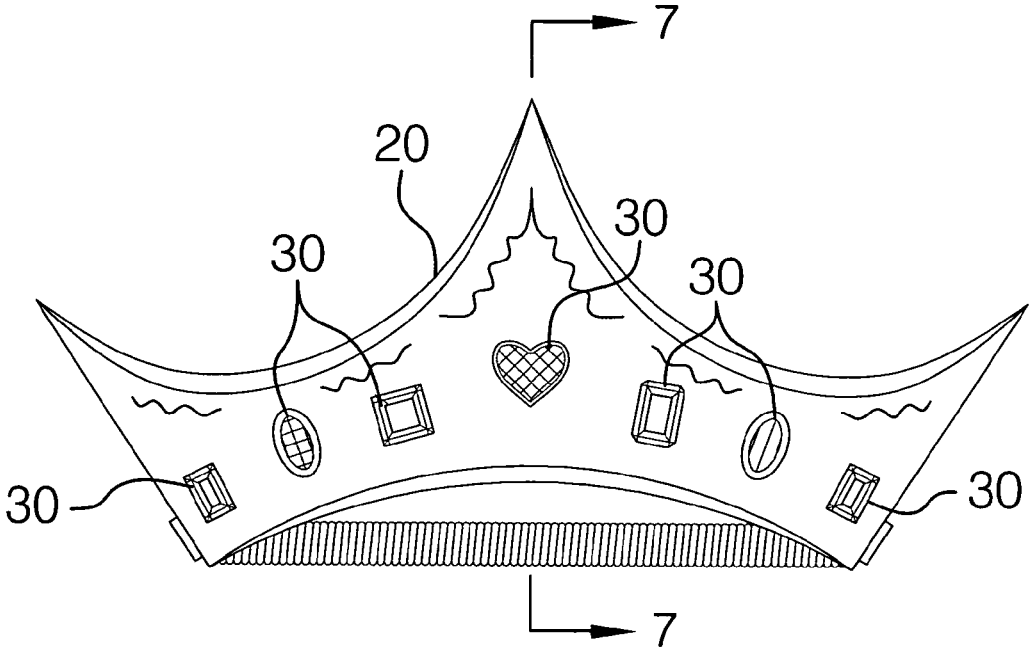
FIG. 6 illustrates a front view of the jewel crown.
Figure 7:
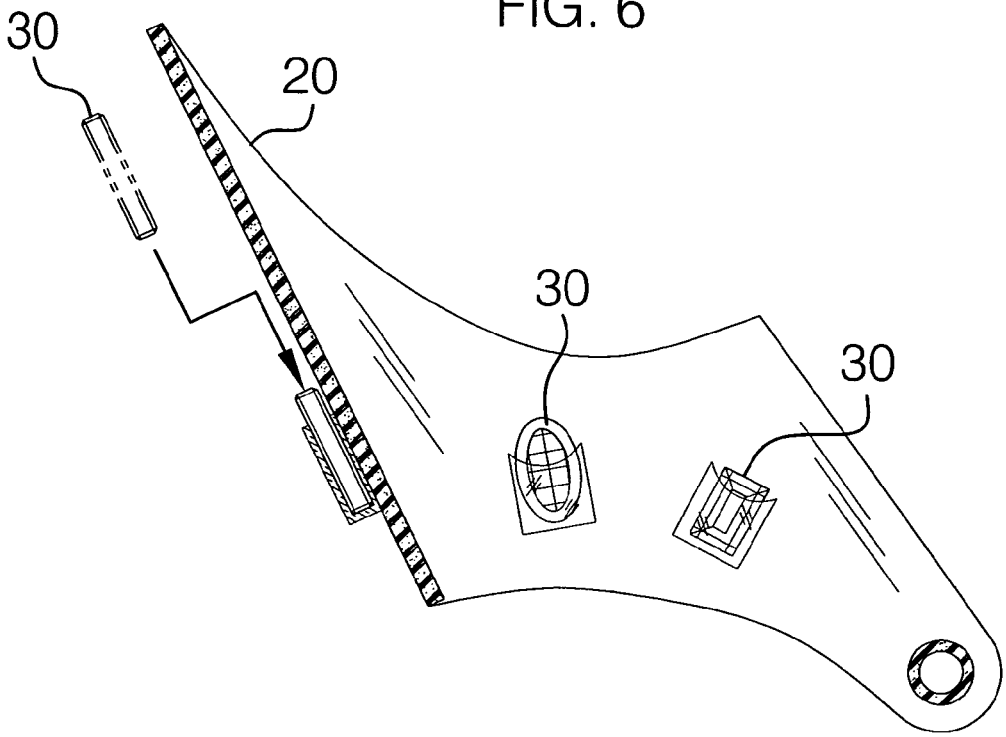
FIG. 7 illustrates a cross-sectional view of the jewel crown along line 7-7 depicting the installation of a jewel.

Detailed reference will now be made to the preferred embodiments of the present invention, examples of which are illustrated in the accompanying drawings. Referring to FIGS. 1-7, the invention comprises a board game 10, a plurality of chance cards 15, a plurality of guide cards 16, a plurality of jewel cards 17, a plurality of differently colored angel player pieces 18, a dice 19, a jewel crown 20, and an assortment of jewels 30.

The objective of the game is to be the first player to go from start to the judging platform on the board game 10. To attempt up the stairways to get to the judging platform on the board game 10, a player must receive a guide card and collect the seven different jewels 30 for the jewel crown 20.

To play the game each person must choose a colored angel playing piece 18. All of the players roll the dice 19 to see who rolls the highest and will go first. Then the first person rolls the dice and moves ahead the number of spaces indicated on the dice 19. Should the angel playing piece 18 stop on a guide card 16, said player shall read the guide card 16 out loud and retain the guide card 16 until all seven jewels 30 are collected on the jewel crown 20.

Should the angel playing piece 18 stop on a jewel card square, the player shall pick a jewel card 17 and receive the corresponding jewel 30. The squares on the board game 15 without pictures or card squares are counted as regular squares.

Two or more players may stop on any square at the same time if their moves happen to land them in that position. If the angel playing piece 18 lands on a "Take A Chance" square, another player must pick up a Chance card 15 and read the question on the Chance card 15 aloud to the player whose angel playing piece 18 landed on said square. The player reading the question on the card may also recite the answer to the player being recited to if s/he answered the question incorrectly. If the answer was correct, the player who made the correct answer may choose one jewel 30 of his/her choice.

Should the angel playing piece 18 land on the go back to start space, another player must pick up and read the question on the chance card 15. If the player answers the question correctly, then s/he may choose a jewel 30 of his/her choice. If the player answers the question incorrectly, then s/he must move the angel playing piece 18 to the start square.

Should the angel playing piece 18 land on a step that has a good deed, then said player may choose a jewel 30 of his/her choice. If the angel playing piece 18 lands on a bad deed step, then the player may not choose a jewel 30 of his/her choice, and the direction indicated on the step should be followed.

If the angel playing piece 18 is directed off of the stairs, then place the angel playing piece 18 on the "go up stairs" space and go around the board and try again on the next staircase. When an angel playing piece 18 is on the steps of the staircase, the player must roll the correct spaces to get to the judging platform.

If the player has received all required seven jewels 30 and has the angel playing piece 18 located on the judging platform space, the player must select another player to read a question from a chance card 15 to said player. If the answer is incorrect, then the player must wait for all of the remaining players to roll their respective turn before he or she can try again. Once the player answers the question correctly, he or she has won the game.

The inventor claims:

1. A method for playing a stairway to heaven board game comprising:

(a) a board game, wherein the board game comprising a peripheral path of spaces and a plurality of secondary staircase paths connecting the peripheral path to a central space on the board;

(b) a plurality of chance cards that have a question and corresponding answer on the back of said card;

(c) a plurality of guide cards;

(d) a plurality of jewel cards;

(e) a plurality of angel playing pieces;

(f) a set of dice;

(g) a plurality of jewels;

(h) a plurality of jewel crowns;

wherein a plurality of spaces can accommodate the plurality of jewels;

wherein the board game further comprises the steps of:

(a) each person must choose a colored angel playing piece and jewel crown;

(b) all of the players roll the dice to see who will go first;

(c) the first person rolls the dice and moves ahead the number of spaces indicated on the dice;

(d) should the angel playing piece stop on a guide card, said player shall read the guide card out loud and retain the guide card until all of the jewels are collected on the jewel crown;

(e) should the angel playing piece stop on a jewel card square, the player shall pick a jewel card and receive the corresponding jewel;

(f) the squares on the board game without pictures or card squares are counted as regular squares;

(g) two or more players may stop on any square at the same time if their respective moves happen to land them in that position;

(h) if the angel playing piece lands on a "Take A Chance" square, another player must pick up a Chance card and read the question on the Chance card aloud to the player whose angel playing piece landed on said square;

(i) the player reading the question on the card may also recite the answer to the player being recited to if s/he answered the question incorrectly;

if the answer was correct, the player who made the correct answer may choose one jewel of his/her choice;

(j) should the angel playing piece land on the go back to start space, another player must pick up and read the question on the chance card;

if the player answers the question correctly, then s/he may choose a jewel of his/her choice;

if the player answers the question incorrectly, then s/he must move the angel playing piece to the start square;

(k) Should the angel playing piece land on a step that has a good deed, then said player may choose a jewel of his/her choice;

if the angel playing piece lands on a bad deed step, then the player may not choose a jewel of his/her choice, and the direction indicated on the step should be followed;

(l) if the angel playing piece is directed off of the stairs, then place the angel playing piece on the "go up stairs" space and go around the board and try again on the next staircase;

when an angel playing piece is on the steps of the staircase, the player must roll the correct spaces to get to the judging platform;

(m) if the player has received all of the jewels and has the angel playing piece located on the judging platform space, the player must select another player to read a question from a chance card to said player;

if the answer is incorrect, then the player must wait for all of the remaining players to roll their respective turn before he or she can try again;

once the player answers the question correctly, he or she has won the game.

2. The stairway to heaven board game as described in claim 1 wherein the angel playing pieces, jewels, and the jewel crown are made from a material comprising a plastic.

3. The stairway to heaven board game as described in claim 1 wherein the questions on the "Chance Cards" are directed to religious questions.

* * * * *